United States Patent [19]

Luft

[11] Patent Number: 4,799,433

[45] Date of Patent: Jan. 24, 1989

[54] LARGE CAPACITY SHIPPING PALLET ASSEMBLY

[75] Inventor: Lee T. Luft, Waukesha, Wis.

[73] Assignee: Menasha Corporation, Neenah, Wis.

[21] Appl. No.: 12,147

[22] Filed: Feb. 6, 1987

[51] Int. Cl.[4] ..... B65D 19/00

[52] U.S. Cl. ..... 108/51.1; 108/56.1

[58] Field of Search ..... 108/51.1, 56.3, 57.1, 108/55.1, 901, 902, 56.1, 55.3, 53.1, 53.3, 53.5, 51.3

[56] References Cited

U.S. PATENT DOCUMENTS

| | | | |
|---|---|---|---|
| 2,699,912 | 1/1955 | Cushman | 108/53.3 X |
| 2,936,985 | 5/1960 | Doerr et al. | 108/51.1 X |
| 3,521,764 | 7/1970 | Loomis | 108/53.1 X |
| 3,667,403 | 6/1972 | Angelbeck, Jr. | 108/51.1 |
| 3,677,201 | 7/1972 | Chadbourne | 108/51.1 |
| 3,680,496 | 8/1972 | Westlake, Jr. | 108/901 X |
| 3,685,463 | 8/1972 | Francis | 108/56.3 |
| 3,691,964 | 9/1972 | Larson et al. | 108/57.1 X |
| 3,696,761 | 10/1972 | Brown | 108/56.3 X |
| 3,702,100 | 11/1972 | Wharton . | |
| 3,824,933 | 7/1974 | Lind | 108/902 X |
| 3,835,792 | 9/1974 | Wharton | 108/902 X |
| 3,926,321 | 12/1975 | Trebilcock | 108/53.1 X |
| 3,949,929 | 4/1976 | Kupersmit | 108/55.1 X |
| 4,000,704 | 1/1977 | Guffin, Jr. | 108/53.3 X |
| 4,013,021 | 3/1977 | Steinlein et al. | 108/901 X |
| 4,051,787 | 10/1977 | Nishitani et al. | 108/51.1 X |
| 4,316,419 | 2/1982 | Cupido | 108/57.1 X |
| 4,604,014 | 8/1986 | Frano | 108/56.3 X |

OTHER PUBLICATIONS

Four page Menasha Corporation product flyer entitled "Convoy Plastic Pallets" undated, admitted prior art.

Seven page Menasha Corporation product brochure entitled "The Convoy Pallet Line" undated, admitted prior art.

*Primary Examiner*—Peter A. Aschenbrenner
*Assistant Examiner*—José V. Chen
*Attorney, Agent, or Firm*—Quarles & Brady

[57] ABSTRACT

A shipping pallet assembly which has the versatility of being interengaged with another identical pallet deck to serve as a base member or with separate foot members. The versatile shipping pallet assembly offers the advantages of reduced tooling costs in that two tools can produce the "two way" pallet and another tool to produce the separate but attachable feet. Additional advantages are in the use of covers for placement over the foot wells to prevent small parts from entering; strips to retard movement of containers and removable portions which permit the conversion to a smaller size pallet deck or openings for the wheels of a hand pallet truck.

19 Claims, 5 Drawing Sheets

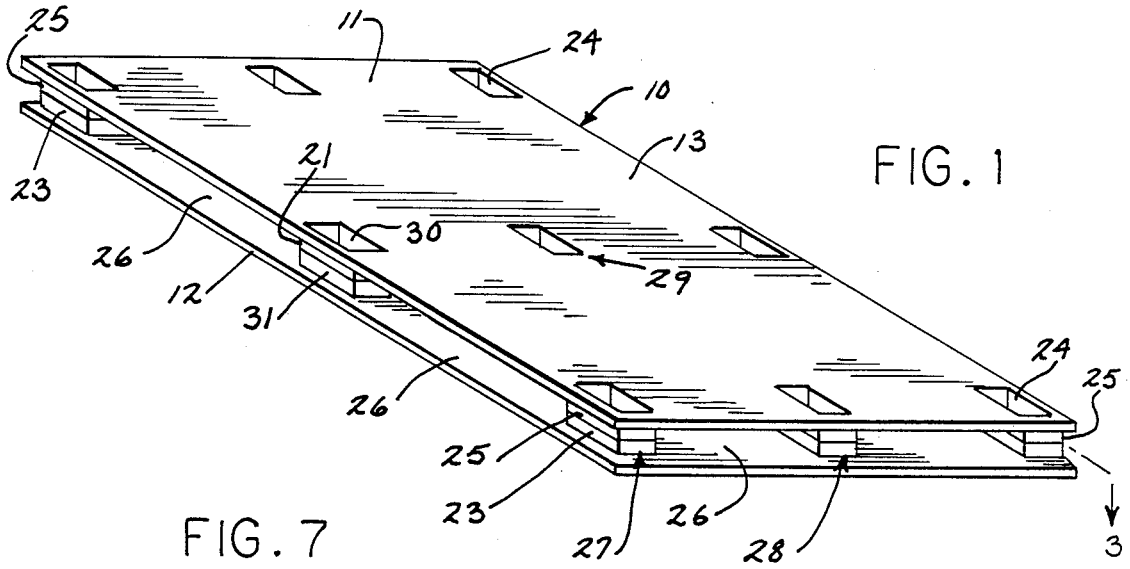
FIG. 1
FIG. 7
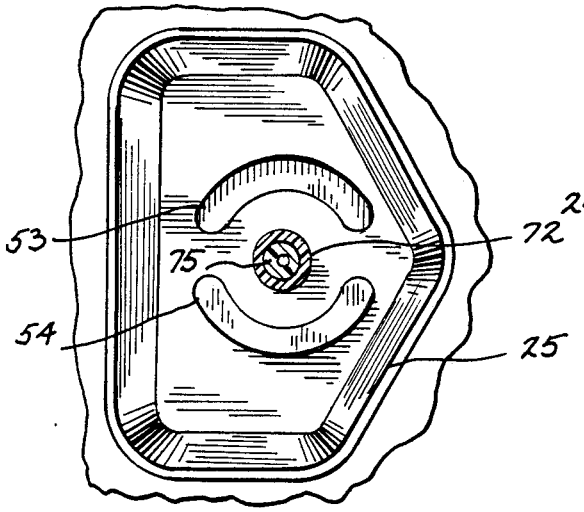
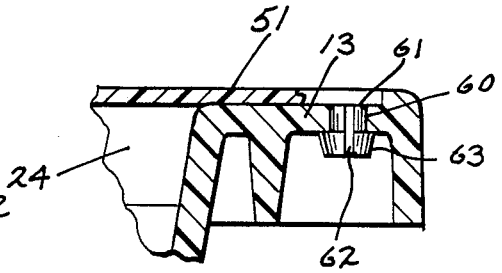
FIG. 9
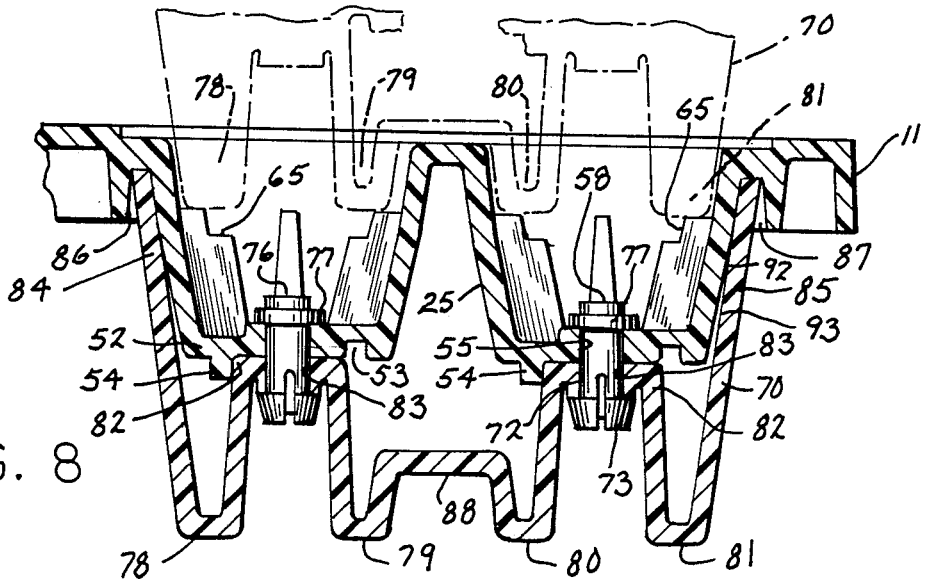
FIG. 8

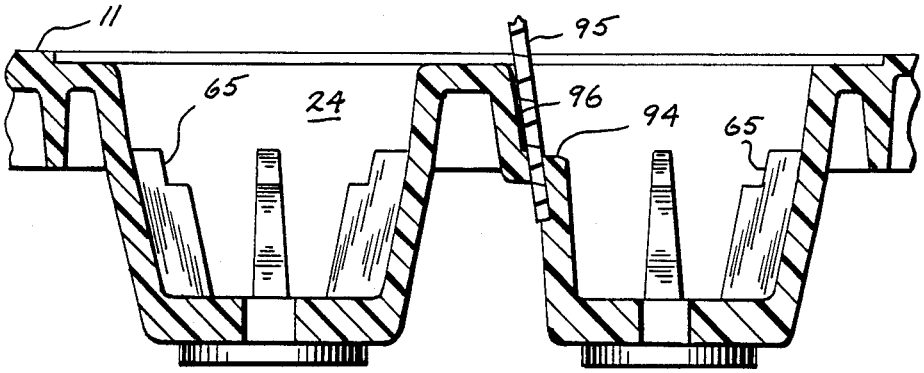
FIG. 10
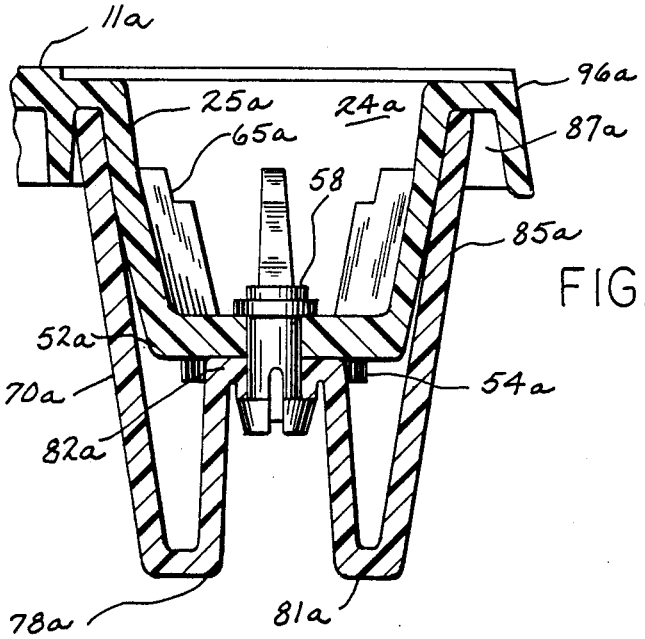
FIG. 11
FIG. 12
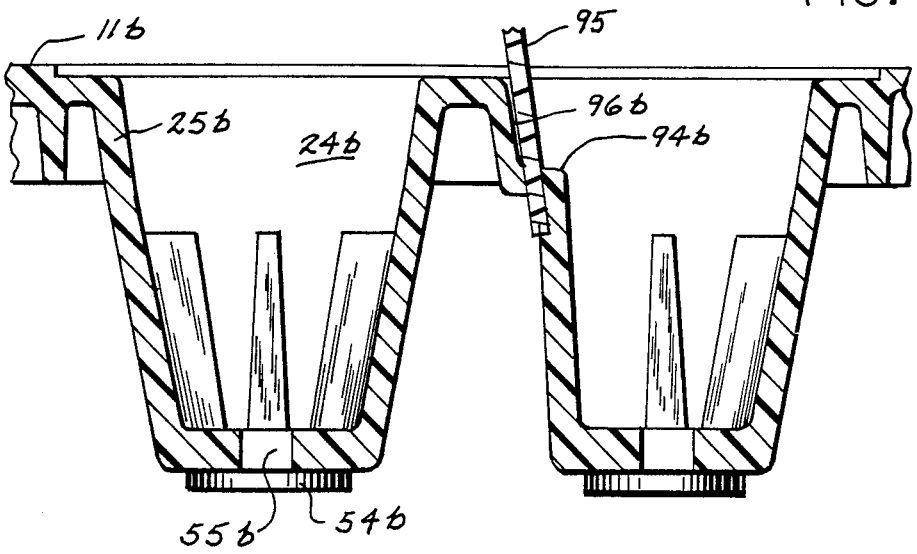

LARGE CAPACITY SHIPPING PALLET ASSEMBLY

BACKGROUND OF THE INVENTION

This invention relates to a molded plastic shipping pallet assembly used to support and transport articles and containers. More particularly this invention relates to a large capacity shipping pallet deck assembly which can have connected thereto as a bottom platform another identical pallet deck for stability purposes or separate foot members as well as covers for the foot wells and friction strips to retard container movement.

There are known pallets with bottom decks which can be fastened to the pallets for purposes of permitting the use with a hand pallet truck. These pallets are available from Applicant's assignee under the trademark Convoy. The Convoy pallets can be used without the bottom deck by having two pallets secured together so as to provide a pallet which is double faced and fully reversible. These pallets are described in U.S. Pat. Nos. 3,702,100 and 3,835,792.

The previously mentioned pallets require separate tooling for the production of the pallet and the bottom deck. In the event a bottom deck is not employed, the pallet is not fork liftable as there is insufficient height between the underside of the pallet deck and the ground or other supporting surface. Further, some of these pallets have drawbacks in that they allow small parts to become lost in compartments or allow containers to slide about in an undesired manner.

It is an advantage of the present invention to provide a pallet assembly which can be manufactured with the minimum amount of tooling.

It is a further advantage of the present invention to provide a pallet assembly of the foregoing type which has foot members for interengaging with identical foot members of an identical pallet deck or can be secured to separate foot members.

It is still another advantage of this invention to provide pallet assemblies of the foregoing type which can reduce the incidence of lost parts and limit movement of containers thereon.

Other advantages are: a deck or pallet which is molded in a manner that portions can be removed therefrom so as to provide different sizes as well as openings for the wheels of a hand pallet truck and a pallet assembly of the foregoing type which is durable and usable under varying weather conditions.

SUMMARY OF THE INVENTION

The foregoing advantages are accomplished and the shortcomings of the prior art are overcome by the present pallet assembly wherein in one embodiment a pallet deck includes a generally planar top surface deck and projecting pedestals. The pedestals comprise foot members preferably in pairs having interengaging means on the ends of the foot members opposite the deck for engagement with foot members of an identical pallet deck or with a separate foot member. The interengaged foot members flank and define a forklift channel. Passage means extend through the foot members of both pallet decks and the separate foot member for orientation and acceptance of fastening means. A compartment is positioned adjacent each pair of pallet deck foot members for receiving projecting wall members of additional and separate supporting foot members.

In one embodiment there are interengaging means on the ends of the projecting feet of the pallet deck opposite the top surface for securing the pallet decks together through the projecting feet. The interengaging means are defined by interfitting groove and flange members which are preferably of an arcuate configuration.

In another embodiment the separate foot member is defined by projecting feet having passage means through the ends thereof for fastening to the foot members of the pallet deck. A compartment is positioned adjacent each pair of foot members of the pallet deck and a projecting wall member extends from the separate foot member for seating in the compartment. The foot members of the pallet deck have substantially flat outer wall surfaces and the projecting wall is constructed and arranged to engage the wall surfaces of the foot members in a flat manner.

In still another embodiment strip members are constructed and arranged to be positioned over the pallet deck opposite the foot members with the strip members having surfaces to reduce the movement of containers placed on the pallet and positioned to contact the containers. Some of the foot members of the pallets are defined by hollow well-like portions and there are cover members constructed and arranged to be placed over the well-like portions. The top surface of both pallet decks have surfaces for contact with wheel-type conveyors. The pallet decks can have markings for cut-a-way portions which can either provide a smaller sized pallet or openings for the wheels of a hand pallet truck. In the latter instance there are ramp surfaces in the pallet adjacent the cut-a-way portion.

BRIEF DESCRIPTION OF THE DRAWINGS

A better understanding of the present pallet assembly will be accomplished by reference to the drawings wherein:

FIG. 1 is a top perspective view of the pallet assembly;

FIG. 7 is a bottom view of one of the foot members for a pallet deck enlarged to show the detail thereof with the fastening means shown in sectional view;

FIG. 8 is a view in vertical section illustrating an additional foot member to be fastened to a pallet deck and with the foot members of another pallet deck shown in a nesting position in phantom lines;

FIG. 9 is an enlarged partial view and in vertical section illustrating the connection of a cover member to a pallet deck;

FIG. 10 is a view in vertical section and enlarged to show the detail of a foot member and the connecting wall of a pallet deck for severing;

FIG. 11 is a view similar to FIG. 8 showing an additional foot member secured to the severed pallet deck of FIG. 10; and FIG. 12 is a view similar to FIG. 10 showing the severing feature for a pallet which can be utilized by itself.

DESCRIPTION OF THE EMBODIMENTS

Figure 2:
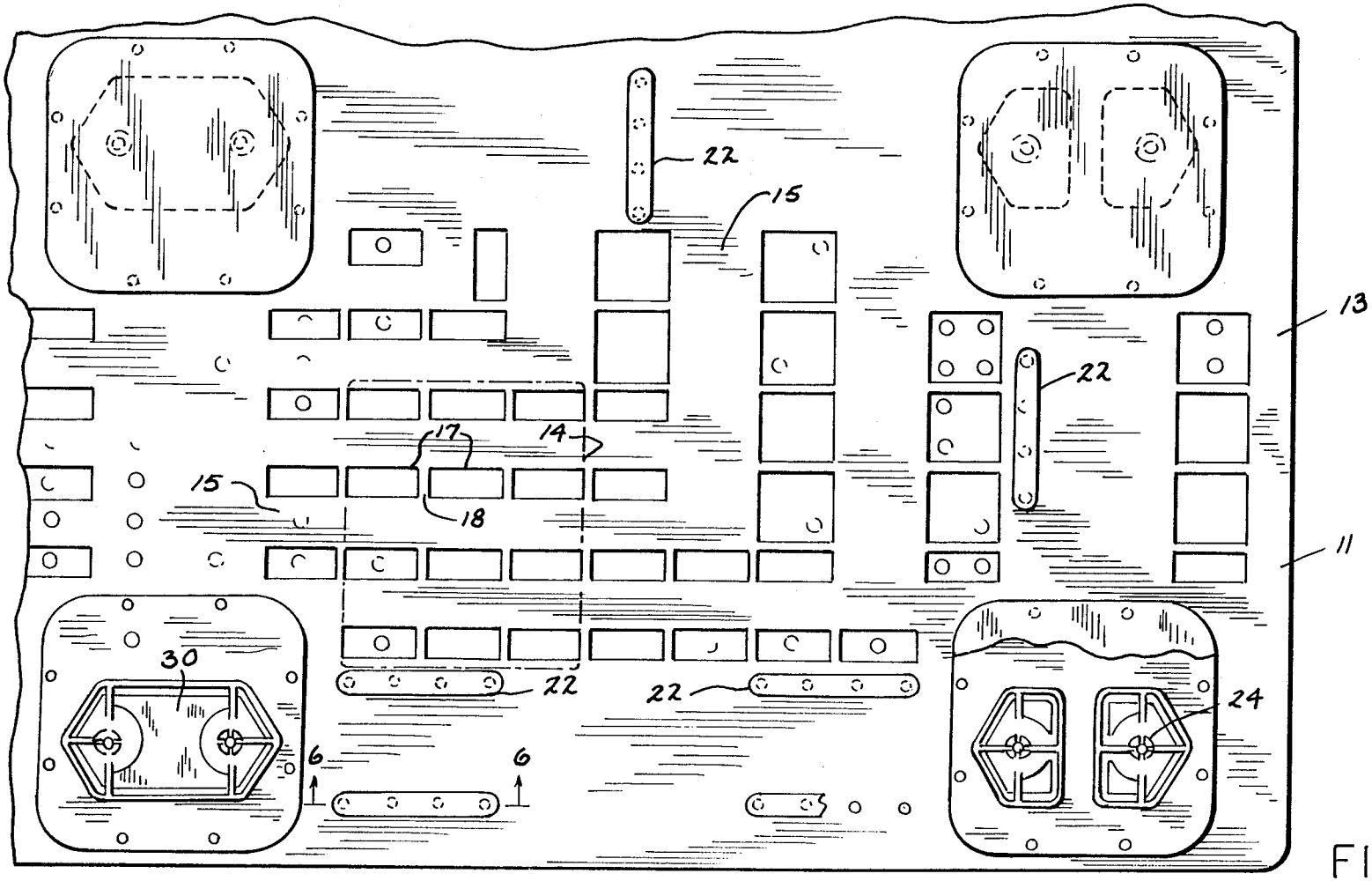
FIG. 2 is an enlarged partial top plan view of pallet deck shown in FIG. 1.
Figure 3:
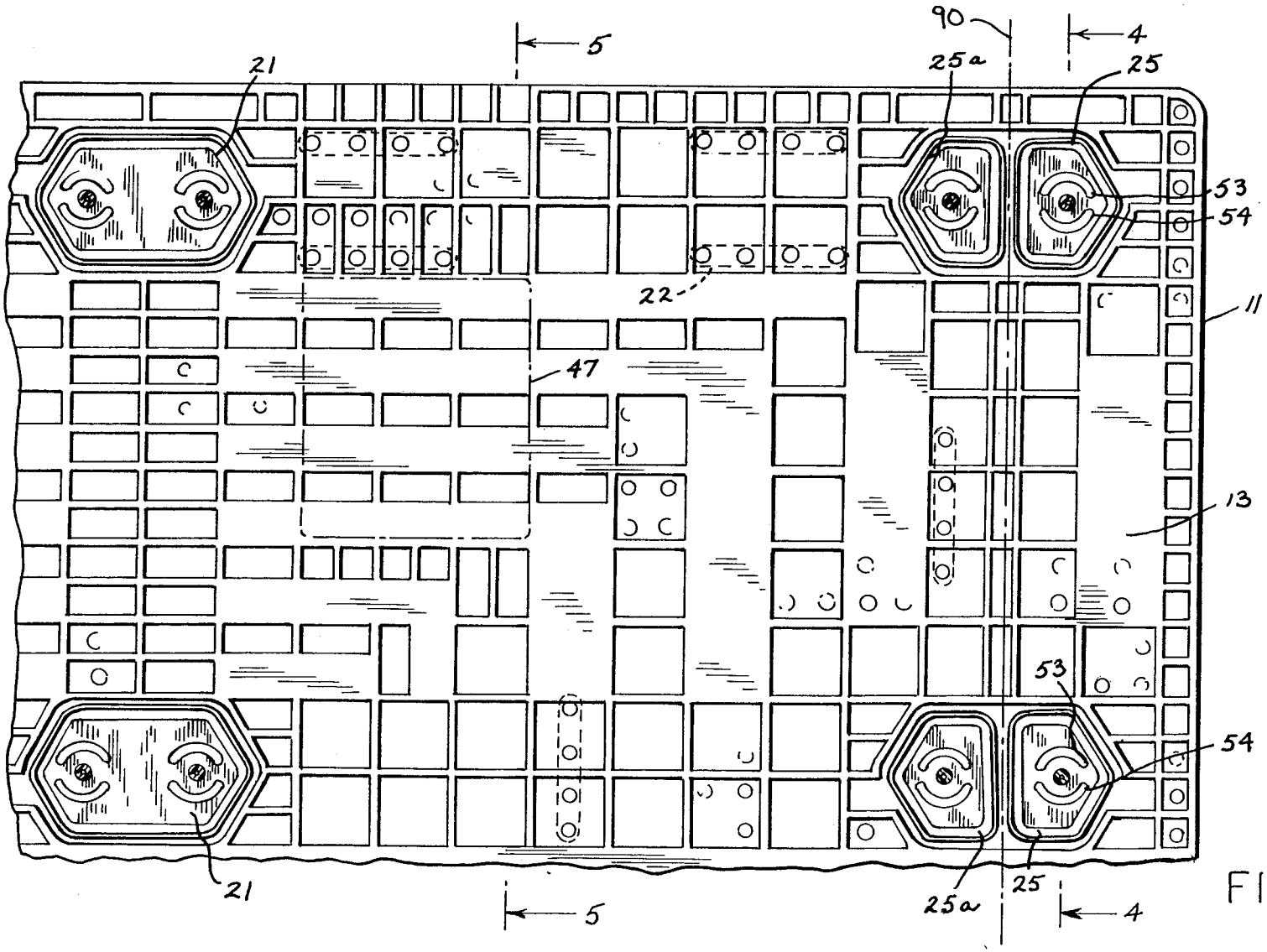
FIG. 3 is a view similar to FIG. 2 except showing a bottom plan view of the pallet deck shown in FIG. 2.

Proceeding to a detailed description of the present pallet assembly generally 10, and particularly FIGS. 1–3, it includes two pallet decks 11 and 12 of identical configuration. Each pallet deck is molded from a rigid plastic material so as to be reusable and withstand varying weather conditions. It has a planar top surface such as 13 for the pallet 11. It is formed in part with a corrugated configuration and has the pockets 17 separated by the ribs 18. Parallel beams 15 are provided between the pockets 17 as well as extend transversely thereto. Projecting pedestals or foot members 25 and 21 extend from the pallet deck 11 and opposite the planar top surface 13. Similarly, pedestals or foot members 23 and 31 extend from the pallet deck 12. These foot members when placed in an interengaging relationship as shown in FIG. 1 will in effect afford corner foot means 27, intermediate foot means 28 and central foot means 29. A forklift channel 26 is thereby provided between the foot means. At the opposite side of the foot means and in the planar deck surface 13 there are the usual open foot well portions 24 for the foot members 25 and foot wells 30 for the foot members 21.

Figure 6:
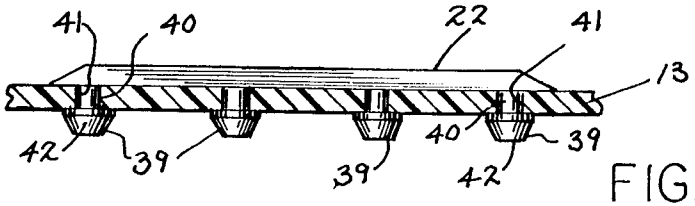
FIG. 6 is a view in vertical section taken along line 6—6 of FIG. 2.

Referring specifically to FIGS. 2 and 6, there are the friction strips 22 which extend above the deck surface and serve to retard movement of a container on the deck surface 13. These strips 22 have the contacting surfaces 20 and the shank 40 with the heads 42 for placement through the openings 41 in the deck 13. In this instance, they are composed of a resilient rubber having a preferred durometer of 70. In this manner the rubber is resilient to provide a non-skid surface yet strong enough to withstand encountering large forces. This rubber construction also allows the heads 42 to be compressed for placement through the openings 41. They can expand to the original size when placed on the opposing side. These strips 22 can be placed on the pallet at the factory or on the job site. As indicated, they can also be positioned at various locations on the pallet depending on the requirements of the user.

Figure 4:
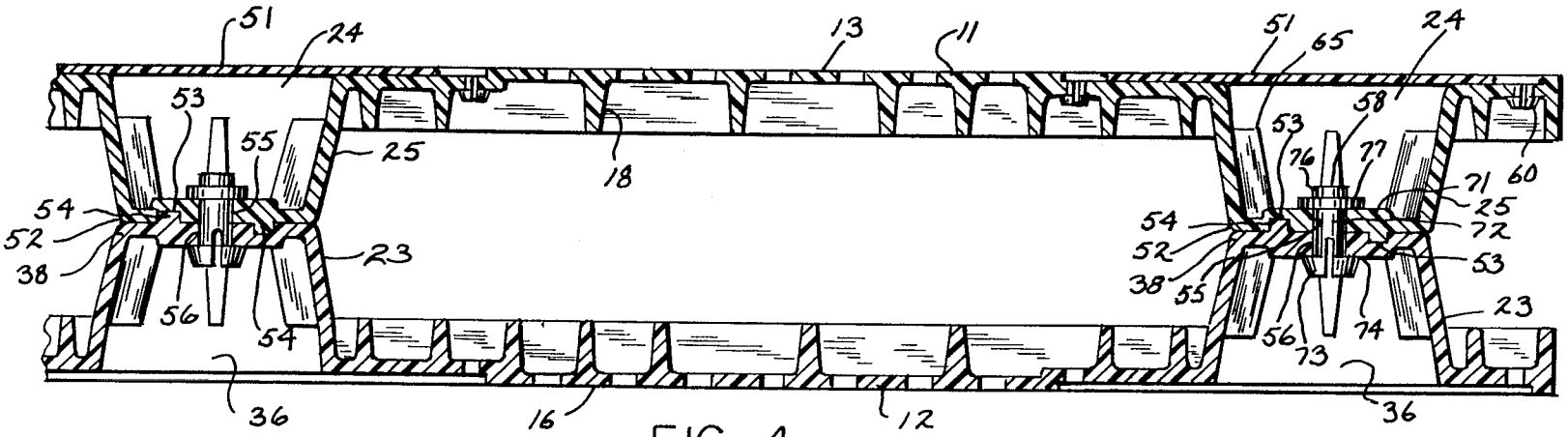
FIG. 4 is a view in vertical section taken along line 4—4 of FIG. 3.

Referring to FIG. 4, this Figure shows the connection between the pallet decks 11 and 12. As seen therein, foot members 23 of the base pallet deck 12 are connected to foot members 25 of the pallet deck 11. This is accomplished by a fastener 58 which is placed in the foot well portions 36 and 24. This connection is further assisted by the flanges 54 extending from the foot bases 38 and 52 of the foot members 23 and 25 for engagement in the grooves 53 of a corresponding foot base. As best seen in FIG. 7 each of the foot members as represented by the foot member 25 has the arcuate groove 53 and the arcuate flange 54. Referring again to FIG. 4, a particular fastener 58 for accomplishing the interconnection is depicted. This fastener 58 has the tubular body 72 for passage through the passages 55 and 56 of the foot bases 52 and 38. It has the barbed and slotted end 73 for contact with the surface 74 on the foot base 38 as well as annular head 77 for contact with surface 71 of the foot base 52. Expansion of the barbed end 73 is effected by inward movement of a plunger or shank 75 (See FIG. 7). The shank 75 preferably has a ribbed surface and is forced through the tubular body 72 by inward movement of the head 76.

Also shown in FIG. 4 as well as FIG. 9 is the attachment of the cover member 51 over the foot well 24. This is accomplished by the integral fastener 60 having the slotted head 63 for compressive passage through the opening 61 in the deck 13 and later expansive retention therein. Nesting ledges 65 are also afforded in the foot well 24 to prevent binding of the foot members of another pallet during nesting such as for return shipping of the empty pallets.

Figure 5:
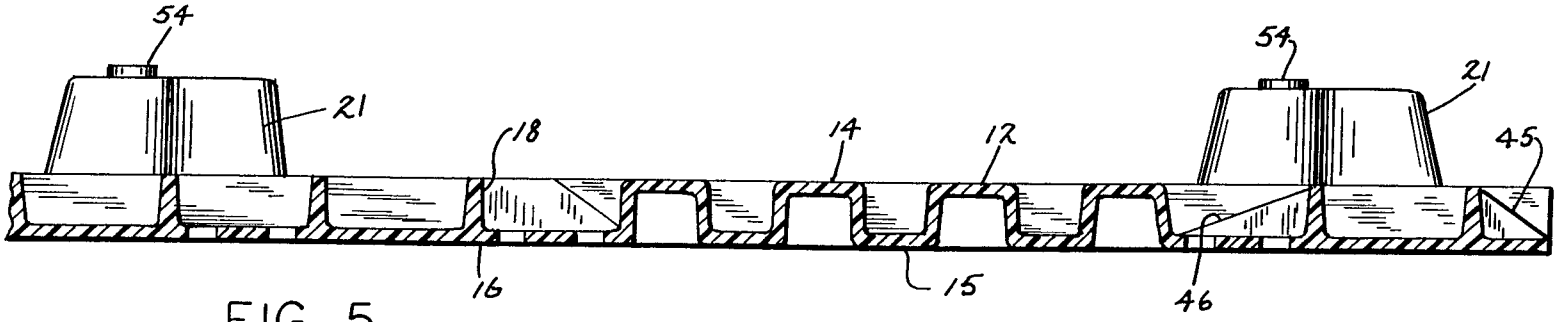
FIG. 5 is a view in vertical section taken along line 5—5 of FIG. 3.

FIG. 5 shows the base pallet deck 12 with the previously described corrugations 14, beams 15 and ribs 18 as well as the lower planar surface deck surface 16. Ramp surfaces 45 and 46 are provided for passage of the wheels of a hand pallet truck. Referring to FIG. 3, there is a rectangular cut line 47. This represents a cut out portion of the pallet in the event it is to be used with the hand pallet truck. The wheels of the truck would contact a floor surface through this opening. Ramp surface 46 would be adjacent the cut out portion.

FIG. 8 represents an alternative embodiment of the pallet assembly. In some instances it may be desirable not to use another pallet deck such as 12 with the pallet deck 11 and still support the pallet deck 11 at a height so that the forks of a forklift can be placed thereunder. For this purpose, foot members such as 70 are used in conjunction with the foot member 25 or 21. These separate foot members 70 have the feet 78, 79, 80 and 81 for resting on a supporting surface. Feet 79 and 80 are connected by the bridge section 88. Feet 78, 79, 80 and 81 are interconnected by the foot bases 82 through which extend the passages 83 for the fastener 58 as previously described for connecting foot members 23. Walls 84 and 85 extend from the feet 78 and 81 for positioning in the compartments 86 and 87. This effects a stable connection. It is noted that the ends of foot bases 82 do not have the grooves 53 and flanges 54 as do the foot members 25 and 23. However, the foot bases 82 contact the flanges 54. This contact as well as the walls 84 and 85 engaging the compartments 86 and 87 and the flat wall surfaces 92 of the foot members 25 engaged by the flat wall surfaces 93 of the foot member 70 provide a stable connection.

The versatility of the pallet assembly of this invention is further seen by the fact that end portions are readily removed if a smaller size pallet is desired. For example, in FIG. 3 there is shown a cut line 90 through the deck 13 of the pallet 11 as well as between the foot members 25 and 25*a*. In the instance where the pallet 11 originally measures 48×72 inches, the removal of 6 inches from each end of the pallet 11 as indicated would result in a pallet measuring 48×60 inches. This would be accomplished without measurably detracting from the foot structure.

FIG. 10 shows a transverse flat wall section 94 in the pallet deck 11 for severing a portion of the pallet deck 11 such as along the line 90 shown in FIG. 3. A saw blade 95 is shown for this purpose. It is seen that a flat wall portion 96 is connected to the transverse wall section 94. This results in a finished and aesthetically pleasing appearance for the pallet deck 11 after cutting along the ends.

FIG. 11 illustrates the pallet deck 11*a* after having the portion severed therefrom and with a foot member 70*a* secured thereto. Similar components are designated with the same numbers as previously described in conjunction with the FIG. 8 description except followed with the letter "a." It is seen that the foot member 70*a* is attached with the fastener 58 and that a compartment 87*a* remains to accommodate the wall 85*a* of the foot member 70*a* such as compartment 87 for wall 85. While a foot member 70*a* is indicated for foot member 25*a* of the severed pallet deck 11*a*, it will be appreciated that two such pallet decks 11*a* after having portions severed therefrom could be secured together as indicated in FIGS. 1 and 4.

FIG. 12 shows the severing feature with saw blade 95 with the wall 94*b* in a full sized pallet 11*b*. Similar components are designated with the same numbers as previously described except followed with the letter "b". In this instance the foot member 25*b* will be of sufficient size as in a regular sized pallet so that a fork of a fork lift truck can be positioned under the full sized pallet 11*b*.

In the previous description, friction type fasteners such as 39 and 60 were described for use in conjunction with the strips 22 and the cover members 51. If desired other types of friction type fasteners could be employed or alternatively screws or nuts and bolts could be substituted. The same is true with respect to the fastener 58. The objective is to have a fastener which can be readily placed between the members and in an economic manner.

It will thus be seen that through the present invention there is now provided a pallet assembly which affords a multitude of adaptations depending upon the type of usage required. This is provided by two pallet decks that can be attached to each other in a foot-to-foot position yet at the same time can have separate foot members attached thereto. Additionally, and when required the pallet assembly affords usage of cover members to be placed over the foot wells of either or both pallet decks so as to prevent entry of small parts as well as better conveying of the base pallet deck. If desired, strip members can be placed on the surface of the pallet deck so as to reduce the incidence of lateral sliding of the container. Pallets of varying sizes can be easily produced by removal of portions of the pallet. Similarly portions can be cut out so as to provide entry of fork truck wheels when a pallet is employed as a base member. The pallet assembly reduces the number of tools required in that one tool can basically produce one pallet deck which can serve as either an upper deck or a base deck with either of the pallet deck members receiving separate foot members which can be produced by a second tool.

I claim:

1. A pallet assembly comprising a pallet deck having a generally planar deck surface and projecting pedestals that flank and define a portion of a forklift channel, wherein:

the pedestals comprise a pair of complete foot members comprising sidewalls extending downwardly from said deck surface and a bottom wall defining an end of said foot member interconnecting the sidewalls, each foot member attached at one of its sidewalls to a sidewall of another foot member and having interengaging means on said ends of said foot members opposite said deck surface for engagement in one instance with foot members of an indentical pallet deck and in another instance with a separate foot member to flank and define in both instances a forklift channel and a cut-a-way portion extending through said attachment of said pair of foot members so that upon separation a smaller sized pallet deck results with a complete foot member.

2. The pallet assembly as defined in claim 1 wherein said foot members include passage means extending through said foot members of both said pallet decks and the separate foot member for orientation and acceptance of a fastening means.

3. The pallet assembly as defined in claim 2 wherein said fastening means is defined by a fastening bolt.

4. The pallet assembly as defined in claim 2 further including interengaging means on the ends of said foot members of both said pallet decks.

5. The pallet assembly as defined in claim 4 wherein said interengaging means are defined by interfitting groove and flange members.

6. The pallet assembly as defined in claim 5 wherein said groove and flange members are of an arcuate configuration.

7. The pallet assembly as defined in claim 1 wherein said foot members include a compartment positioned adjacent each said pair of foot members for receiving projecting wall members of said separate foot member.

8. The pallet assembly as defined in claim 1 wherein said separate foot member is defined by projecting feet having passage means through the ends thereof for fastening to said foot members of said pallet, a compartment positioned adjacent each said foot members of said pallet, and projecting wall member extending form said separate foot member for seating in said compartment.

9. The pallet assembly as defined in claim 8 wherein foot members of said pallet deck have substantially flat outer wall surfaces and said projecting wall is constructed and arranged to engage said wall surfaces of said foot members in a flat manner.

10. The pallet assembly as defined in claim 1 further including strip members constructed and arranged to be positioned over and through said deck surface in a compressible manner opposite said foot members, said strip members having frictional engaging surfaces to reduce movement of containers placed on said pallet deck and positioned to contact said containers.

11. The pallet assembly as defined in claim 1 wherein at least some of said foot members are defined by hollow well-like portions and further including cover members constructed and arranged to be placed over said well-like portions.

12. The pallet assembly as defined in claim 1 wherein at least one of the deck surfaces of both said pallet decks have surfaces for contact with wheel-type conveyors.

13. The pallet assembly as defined in claim 1 wherein one of said pallet decks have markings for a cut-a-way portion.

14. The pallet assembly as defined in claim 13 wherein said second cut-a-way portion is a cut-out portion.

15. The pallet assembly as defined in claim 14 further including ramp surfaces adjacent cut-out portion.

16. The pallet assembly as defined in claim 1 wherein both said pallet decks are secured together by means of fastening means.

17. The pallet assembly as defined in claim 1 wherein said separate foot member is secured to one of said pallet deck by means of fastening means.

18. The pallet assembly as defined in claim 1 wherein said cut-a-way portion is defined in part by a wall section.

19. The pallet assembly as defined in claim 18 wherein a said separate foot member is secured to said resulting foot member.

* * * * *

UNITED STATES PATENT AND TRADEMARK OFFICE

CERTIFICATE OF CORRECTION

PATENT NO. : 4,799,433

DATED : January 24, 1989

INVENTOR(S) : Luft

It is certified that error appears in the above-identified patent and that said Letters Patent is hereby corrected as shown below:

| | |
|---|---|
| Column 6, line 26 | after and --a-- should appear |
| Column 6, line 26 | "form" should read --from-- |
| Column 6, line 49 | before cut-a-way --second-- should appear |
| Column 6, line 55 | before cut-out --said-- should appear |
| Column 6, line 67 | before foot "resulting" should read --complete-- |

Signed and Sealed this

Twelfth Day of December, 1989

*Attest:*

JEFFREY M. SAMUELS

*Attesting Officer*

*Acting Commissioner of Patents and Trademarks*